United States Patent [19]

Chandley et al.

[11] Patent Number: 4,589,466

[45] Date of Patent: May 20, 1986

[54] METAL CASTING

[75] Inventors: George D. Chandley; Eugene W. Thomas, both of Amherst, N.H.

[73] Assignee: Hitchiner Manufacturing Co., Inc., Milford, N.H.

[21] Appl. No.: 738,688

[22] Filed: May 28, 1985

Related U.S. Application Data

[63] Continuation-in-part of Ser. No. 583,828, Feb. 27, 1984, abandoned.

[51] Int. Cl.[4] ..... B22D 18/04; B22D 37/00

[52] U.S. Cl. ..... 164/119; 164/133; 164/306; 164/337; 222/600

[58] Field of Search ..... 164/61, 63, 65, 76.1, 164/113, 119, 133, 155, 253–258, 306–309, 337, 457; 222/528, 529, 594, 597, 600

[56] References Cited

U.S. PATENT DOCUMENTS

| | | | |
|---|---|---|---|
| 3,774,668 | 11/1973 | Heimgartner | 164/63 |
| 3,863,706 | 2/1975 | Chandley et al. | 164/306 |
| 3,900,064 | 8/1975 | Chandley et al. | 164/306 |
| 3,976,277 | 8/1976 | Basel et al. | 222/529 |
| 4,112,997 | 9/1978 | Chandley | 164/119 |
| 4,142,651 | 3/1979 | Leopoldi et al. | 222/529 |

FOREIGN PATENT DOCUMENTS

| | | | |
|---|---|---|---|
| 0580948 | 11/1977 | U.S.S.R. | 164/337 |

OTHER PUBLICATIONS

"Drip Free Dispensing of Viscous Liquids", J. W. Grubb, *Western Electric Technical Digest,* No. 62, Apr. 1981, pp. 3–4.

*Primary Examiner*—Nicholas P. Godici
*Assistant Examiner*—Richard K. Seidel
*Attorney, Agent, or Firm*—Edgar H. Kent

[57] ABSTRACT

Apparatus and methods for differential pressure, counter gravity, casting of metal in a gas-permeable mold having a vertical passage with a lower open end for introducing molten metal into its mold cavity means. A crucible is provided for holding molten metal with its surface positioned beneath the mold. The crucible and the mold are relatively movable toward and away from one another for introducing molten metal into the lower open end of the mold, and pressure means is provided for applying a differential pressure to the mold and crucible to cause molten metal to fill the mold cavity means through the vertical passage. A rigid, permanently crimpable fill pipe is sealingly connected to the lower open end of the vertical mold passage with its lower end extending vertically downwardly toward the crucible. Fill pipe crimping means is positioned between the mold and crucible for selectively permanently crimping the fill pipe to close it, after filling of the mold cavity means, to prevent reverse flow of molten metal from the mold to the crucible as the mold and fill pipe are moved relatively away from the crucible.

12 Claims, 3 Drawing Figures

METAL CASTING

BACKGROUND OF THE INVENTION

Figure 1:
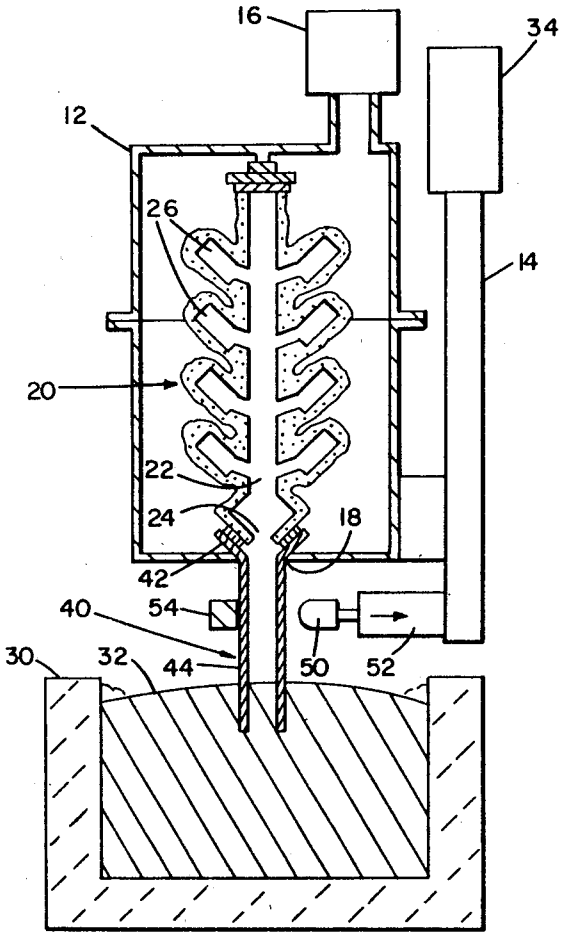

This application is a continuation-in-part of our application, Ser. No. 583,828, filed Feb. 27, 1984now abandoned. Its invention relates to metal casting apparatus and methods and, more particularly, to counter gravity, differential pressure, metal casting apparatus of the type generally disclosed in U.S. Pat. Nos. 3,863,706, 3,900,064 and 4,112,997, which are incorporated by reference herein.

Although the apparatus and methods disclosed in these patents have been in successful commercial use for many years, castings of certain high melting point metal alloys having wall thickness in excess of about ¾ inch cannot be made economically by their use, since screens as disclosed in U.S. Pat. No. 4,112,997 cannot be used because they react with such alloys and without screens such thick castings require an uneconomical time to solidify.

In an attempt to find a solution, ceramic ball check valves have been used, but have proved to be both uneconomical and unreliable with many of such alloys, since they tend to erode the ceramic, causing the ball to jam in its open position, so that the molten metal can run back into the crucible before solidifying, resulting in ruined castings.

Accordingly, it is a major object of the invention to provide novel apparatus and methods for differential pressure, counter gravity, metal casting, particularly of certain high melting point metal alloys, to provide for the economical casting of relatively thick walled castings of such alloys.

SUMMARY OF THE INVENTION

This has been accomplished, according to the present invention, by providing, in casting apparatus including a gas-permeable mold having a vertical passage with a lower open end for introducing molten metal into its mold cavity means, a crucible for holding molten metal with its surface positioned beneath the mold, power means for relatively moving the crucible and mold toward and away from one another for introducing molten metal from the crucible into the lower open end of the mold, and pressure means for applying a differential pressure to the mold and crucible to cause molten metal to fill the mold cavity means through the vertical passage, that improvement consisting of a rigid, permanently crimpable metal fill pipe sealingly connected to the lower open end of the vertical mold passage with its lower end extending vertically downwardly toward the crucible, and fill pipe crimping means positioned between the mold and crucible for selectively permanently crimping the fill pipe to close it after filling of the mold cavity means to prevent reverse flow of molten metal from the mold to the crucible.

According to the methods of the present invention, the fill pipe and mold are moved relatively toward the crucible to move the lower end of the fill pipe beneath the surface of the molten metal, a differential pressure is applied to the mold and crucible to cause molten metal to fill the mold cavity means through the fill pipe, and the fill pipe is thereafter permanently crimped to close it, preferably by welding, to prevent reverse flow of molten metal from the mold cavity means to the crucible as the mold and fill pipe are moved relatively away from the crucible.

DESCRIPTION OF THE PREFFERED EMBODIMENTS

Figure 2:
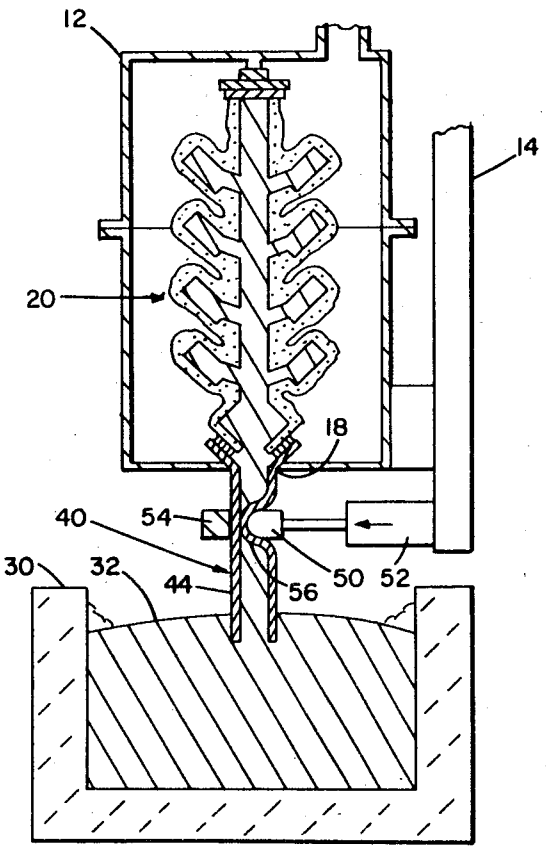
Figure 3:
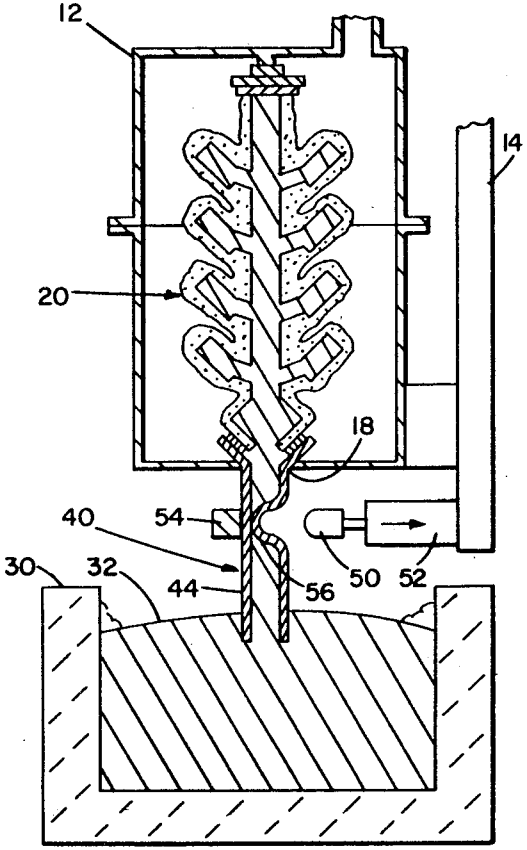

For the purpose of fully explaining the above and further objects of the invention, reference is now made to the following detailed description of preferred embodiments thereof, together with the accompanying drawings, wherein:

FIGS. 1, 2 and 3 are schematic sectional side views of the apparatus of the invention, illustrating successive steps in the operation of the methods of the invention.

Referring to the drawings, there is provided a partible sealable loading compartment 12 mounted on vertically movable support 14. Loading compartment 12 has, in its upper wall, a connection to differential pressure apparatus 16 and, in its lower mold supporting wall, a central opening 18 for supporting a gas permeable mold, generally designated 20, which may be of the shell type disclosed in said patents, having a vertical passage 22 with a lower open end 24 for introducing molten metal into mold cavities 26 therein. A crucible 30 for holding molten metal, providing an exposed molten metal upper surface 32, is positioned beneath loading compartment 12. Differential pressure apparatus 16 can be selectively operated in the usual manner to apply a differential pressure to compartment 12 and mold 20 relatively to crucible 30 to cause molten metal to fill mold cavities 26 through vertical mold passage 22. A hydraulic power cylinder 34 connected to movable support 14 is provided for relatively moving crucible 30 and compartment 12 with mold 20 toward and away from one another by selectively raising or lowering compartment 12 with mold 20.

According to the present invention, there is provided a single use, removable, rigid, permanently crimpable, disposable, hollow metal fill pipe, generally designated 40, having an upper flared portion providing a radially outwardly extending upper flange 42 with a lower portion 44 extending vertically downwardly therefrom. Upper flange 42 is sealingly interposed between the lower mold supporting wall of container 12 and the lower end of mold 20 around its opening 24 and lower portion 44 extends through central opening 18 of container 12 and vertically downwardly therefrom toward the molten metal surface 32 in crucible 30. A fill pipe crimping device, which may consist of a horizontally movable crimping element 50 operated by a hydraulic cylinder 52 mounted on the lower end of vertically movable support 14 and an opposed abutment 54, also mounted on support 14, is positioned between compartment 12 and crucible 30, with element 50 and abutment 54 on opposite sides of the lower portion 44 of fill pipe 40 in lowered position, as shown in the drawings, for selectively permanently crimping the lower portion 44 of fill pipe 40 to permanently close it after the filling of mold cavities 26 has been completed, in order to prevent reverse flow of molten metal back into crucible 30 as container 12 with mold 20 and fill pipe 40 are moved upwardly relatively away from crucible 30. At least the lower portion 44 of fill pipe 40 is of crimpable metal so that it can be permanently deformed by the advance of crimping element 50 toward abutment 54 to provide a permanently crimped portion 56, as shown in FIGS. 2 and 3, to permanently close its hollow interior to prevent flow of molten metal therethrough, even after crimping element 50 has been retracted, as shown in FIG. 3. In practice, with most fill pipe metals, fill pipe crimped portion 56 is welded closed by the action of crimping element 50 and abutment 54, with the weld being maintained because of the rapid heat loss from the metal fill pipe 40.

In operation, according to the methods of the invention, first, the lower portion 44 of fill pipe 40 is inserted through the lower opening 18 of open container 12, so that its flared upper portion 42 is supported by the lower wall of container 12 and its lower end portion 44 extends vertically downwardly toward crucible 30, spaced above the surface 32 of the molten metal in crucible 30. Next, mold 20 is placed on the upper surface of flared fill pipe portion 44 with its lower open end 24 concentric with fill pipe 40 so that fill pipe 40 is removably sealingly connected between the lower open end 24 of vertical mold passage 22 and the lower wall of container 12 surrounding container lower opening 18. Container 12 is then closed and connected to differential pressure apparatus 16.

Thereafter, container 12 with mold 20 and fill pipe 40 is moved downwardly by operating hydraulic power cylinder 34 to move the lower end of fill pipe 40 beneath the surface 32 of molten metal in crucible 30 to introduce molten metal from crucible 30 into the lower end of fill pipe 40, as shown in FIG. 1. A reduced differential pressure is then applied to container 12 and so to mold 20 by operating differential pressure apparatus 16 to cause molten metal to fill mold cavities 26 through fill pipe 40 and central vertical mold passage 22.

After mold cavities 26 have been filled, horizontally movable crimping element 50 is operated by hydraulic cylinder 52 to advance it horizontally toward opposed abutment 54 on the opposite side of the lower portion 44 of fill pipe 40, as shown in FIG. 2, to crimp the lower portion 44 of fill pipe 40 to provide a permanently crimped portion 56, as shown in FIGS. 2 and 3, to permanently close its hollow interior, preferably even after crimping element 50 has been retracted, as shown in FIG. 3, to prevent reverse flow of molten metal back into crucible 30 as container 12 with mold 20 and fill pipe 40 are moved upwardly relatively away from crucible 30. In practice, as noted above, the interior walls of fill pipe crimped portion 56 are welded closed by the action of crimping element 50 and abutment 54, by the application of crimping force for only a second or two, after which crimping element 54 is retracted, with the weld thereafter being maintained because of the rapid heat loss from the metal fill pipe 40. This is a particular advantage, since it reduces the casting cycle time and so increases production.

Finally, container 12 is opened and the filled mold 20 and fill pipe 40, locked together by the solidified metal, are removed in preparation for another molding cycle, and pipe 40 is removed from mold 20.

It is important that the metal or alloy of fill pipe be compatible with that being cast, so that, at least in some instances, the identical alloy be used. Since this will result in the lower end of fill pipe 40 melting as it is introduced to the surface 32 of molten metal in crucible 30, it is contemplated that hydraulic power cylinder 34 be operated to continue to move container 12 downwardly during the filling cycle of mold 20, after which its downward movement can be terminated and crimping element 50 operated to crimp fill pipe 40, after which further melting of the lower end of fill pipe is of no importance.

Alternatively, fill pipe 40 may have a thin ceramic outer coating, which, because of the short time fill pipe 40 is submerged in molten metal, prevents it from melting, but does not interfere with its crimping or welding. As another alternative, the lower portion of fill pipe 40 to be submerged in molten metal, below the portion to be crimped, may be of ceramic, since, due to the short time the lower portion of fill pipe 40 is submerged, only that portion of fill pipe 40 which is actually submerged is subject to melting.

We have discovered that, since the metal of the fill pipe almost always has a melting point substantially below the temperature of the metal in the crucible and the bare fill pipe melts rapidly, if the pipe is too thin, the pipe will collapse and the process will not work. If the pipe is too thick, metal solidifies on the inner and outer surfaces also rendering the process impractical. We have determined that the practical wall thickness for such a single use fill pipe in the range of diameters of one to three inches and lengths of five to 30 inches is 0.060 to 0.180 inches. This range of wall thickness is also compatible with formation of and maintenance of a permanently welded crimp.

We have also discovered that the location of the crimp must be at a distance of at least 1.5 times the pipe diameter from the pipe upper end and flange so that the crimping action does not distort the pipe flange and allow molten metal to run out of the joint between it and the permeable mold.

Although the description of the preferred embodiment herein has referred to molds of shell type disclosed in U.S. Pat. Nos. 3,863,706, 3,900,064 and 4,112,997, it is contemplated that other types of gas permeable molds may also be used in the practice of the invention, including conventional bonded or unbonded sand molds, as well as those of the "lost foam" type. In the latter, molding sand is packed around a polystyrene foam pattern with gating and molten metal is introduced directly into the foam, which vaporizes and escapes through the molding sand, leaving a casting which is a replica of the foam pattern.

Still further modifications of the invention, within the spirit of the invention and the scope of the claims, will be apparent to those skilled in the metal casting art.

What is claimed is:

1. In casting apparatus, including a gas permeable mold having a vertical passage with a lower open end for introducing molten metal into mold cavity means therein a crucible for holding molten metal with its surface positioned beneath said mold power means for relatively moving said crucible and said mold toward and away from one another, and pressure means for applying a differential pressure to said mold and crucible to cause said molten metal to fill said mold cavity means through said vertical passage, that improvement consisting of a rigid, permanently crimpable metal fill pipe removably and sealingly connected to the lower open end of said vertical mold passage with its lower end extending vertically downwardly therefrom toward said crucible, and releasable fill pipe crimping means positioned between said mold and said crucible for selectively permanently crimping said fill pipe to close it after filling of said mold cavity means to prevent reverse flow of molten metal from said mold to said crucible as said mold and fill pipe are moved relatively away from said crucible.

2. Apparatus as claimed in claim 1, wherein said fill pipe is permanently closed by said crimping means by welding together the interior walls of said fill pipe.

3. In casting apparatus, including a gas-permeable mold having a vertical passage with a lower open end for introducing molten metal into mold cavity mean therein mold support means having a lower opening positioned beneath said mold passage lower open end a crucible for holding molten metal with its surface positioned beneath said mold support means power means for relatively moving said crucible and said mold toward and away from one another, and pressure means for applying a differential pressure to said mold and crucible to cause said molten metal to fill said mold cavity means through said vertical passage.

that improvement consisting of a rigid, permanently crimpable metal fill pipe having a radially outwardly extending upper flange removably and sealingly interposed between and surrounding said mold passage lower open end and said mold support means lower opening connected with its lower end extending vertically downwardly therefrom toward said crucible, and releasable fill pipe crimping means positioned between said mold and said crucible for selectively permanently crimping said fill pipe to close it after filling of said mold cavity means to prevent reverse flow of molten metal from said mold to said crucible as said mold and fill pipe are moved relatively away from said crucible, said crimping means thereafter being opened to release said fill pipe for its removal.

4. A method of casting in a gas permeable mold, comprising the steps of:

providing a gas-permeable mold having a vertical passage with a lower open end for introducing molten metal into mold cavity means therein providing a crucible for holding molten metal with its surface positioned beneath said mold providing a rigid, permanently crimpable metal fill pipe sealingly connected to the lower open end of said vertical mold passage with its lower end extending vertically downwardly therefrom toward said crucible relatively moving said mold and fill pipe toward said crucible to move the lower end of said fill pipe beneath the surface of molten metal in said crucible to introduce molten metal from said crucible into the lower end of said fill pipe applying a differential pressure to said mold and crucible to cause said molten metal to fill said mold cavity means through said fill pipe, and permanently crimping said fill pipe to close it after filling of said mold cavity means to prevent reverse flow of molten metal from said mold cavity means to said crucible as said mold and fill pipe are moved relatively away from said crucible.

5. Apparatus as claimed in claims 3 or 9, wherein said crucible contains molten metal at a predetermined temperature and said fill pipe melts at a temperature less than said predetermined temperature of said molten metal in said crucible.

6. A method of casting in a gas permeable mold, comprising the steps of:

providing a gas permeable mold having a vertical passage with a lower open end for introducing molten metal into mold cavity means therein providing a mold support having a lower opening positioned beneath said mold passage lower open end providing a crucible for holding molten metal with its surface positioned beneath said mold support providing a rigid, permanently crimpable metal fill pipe having a radially outwardly extending upper flange removeably sealingly interposed between and surrounding said mold passage lower open end and said mold support lower opening with its lower end extending vertically downwardly therefrom toward said crucible relatively moving said mold and fill pipe toward said crucible to move the lower end of said fill pipe beneath the surface of molten metal in said crucible to introduce molten metal from said crucible into the lower end of said fill pipe applying a differential pressure to said mold and crucible to cause said molten metal to fill said mold cavity means through said fill pipe, crimping said fill pipe to close it after filling of said mold cavity means to prevent reverse flow of molten metal from said mold cavity means to said crucible as said mold and fill pipe are moved relatively away from said crucible, and finally removing said fill pipe from said mold and support.

7. A method as claimed in claims 6, 7, 8 or 10, wherein said fill pipe melts at a temperature less than the temperature of molten metal in said crucible.

8. A method as claimed in claim 4 wherein the interior walls of said fill pipe are permanently welded together by said crimping to permanently close said fill pipe.

9. Apparatus as claimed in claim 3 wherein said fill pipe is permanently closed by said crimping means by welding together the interior walls of said fill pipe.

10. A method as claimed in claim 6, wherein the interior walls of said fill pipe are permanently welded together by said crimping to permanently close said fill pipe.

11. Apparatus as claimed in claims 1, 2, or 9, wherein said fill pipe has a wall thickness of between 0.060 to 0.180 inches and is crimped at a distance of at least 1.5 times the pipe diameter from its upper end.

12. A method as claimed in claims 6, 7, 8 or 10 wherein said fill pipe has a wall thickness of between 0.060 to 0.180 inches and is crimped at a distance of at least 1.5 times the pipe diameter from its upper end.

* * * * *